US005520827A

United States Patent [19]

Danner

[11] Patent Number: 5,520,827

[45] Date of Patent: May 28, 1996

[54] MICROEMULSIONS OF AMINOPOLYSILOXANES

[75] Inventor: Bernard Danner, Riedisheim, France

[73] Assignee: Sandoz Ltd., Basel, Switzerland

[21] Appl. No.: 340,107

[22] Filed: Nov. 15, 1994

Related U.S. Application Data

[63] Continuation of Ser. No. 192,227, Feb. 4, 1994, abandoned, which is a continuation of Ser. No. 878,790, May 5, 1992, abandoned, which is a continuation of Ser. No. 579,422, Sep. 7, 1990, abandoned.

[30] Foreign Application Priority Data

Sep. 7, 1989 [DE] Germany ..... 39 29 757.8
Aug. 17, 1990 [DE] Germany ..... 40 26 029.1

[51] Int. Cl.[6] ..... D06C 29/00

[52] U.S. Cl. ..... 252/8.6; 252/8.7; 252/8.75; 252/8.8; 252/8.9; 252/174.15; 106/287.1; 524/864

[58] Field of Search ..... 524/864; 106/287.11; 252/8.6, 8.7, 8.75, 8.8, 8.9, 174.15

[56] References Cited

U.S. PATENT DOCUMENTS

| | | | |
|---|---|---|---|
| 4,446,034 | 5/1984 | Kolbe et al. | 252/8.8 |
| 4,559,227 | 12/1985 | Chandra et al. | 424/70 |
| 4,584,125 | 4/1986 | Griswold et al. | 252/358 |
| 4,620,878 | 11/1986 | Gee | 106/287.15 |
| 4,888,368 | 12/1989 | Kohl et al. | 524/92 |
| 4,978,561 | 12/1990 | Cray et al. | 427/387 |
| 4,983,383 | 1/1991 | Maksimoski et al. | 424/70 |
| 5,017,297 | 5/1991 | Spyropoulos et al. | 252/8.8 |
| 5,064,544 | 11/1991 | Lin et al. | 252/88 |
| 5,071,573 | 12/1991 | Coffindaffer et al. | 252/8.8 |
| 5,104,555 | 4/1992 | Foster et al. | 252/8.6 |
| 5,126,126 | 6/1992 | Varaprath et al. | 424/71 |
| 5,160,449 | 11/1992 | Halloran | 252/174.15 |
| 5,173,201 | 12/1992 | Coffindaffer et al. | 252/8.8 |
| 5,174,912 | 12/1992 | Coffindaffer et al. | 252/8.8 |
| 5,336,715 | 8/1994 | Sejpka et al. | 524/765 |

FOREIGN PATENT DOCUMENTS

| | | |
|---|---|---|
| 0150872 | 8/1985 | European Pat. Off. . |
| 3930410 | 3/1991 | Germany . |

OTHER PUBLICATIONS

"Microemulsions and Related Systems" Formulation, Solvency, and Physical Properties, Surfactant Science Series, vol. 30, Preface v–viii Oct. 28, 1982.

Kokai (Jpn. Unexamined Patent Publication) No. 63–307810—Publication Date: Dec. 15, 1988 (English Translation).

Kokai (Jpn. Unexamined Patent Publication) No. 63–307811—Publication Date: Dec. 15, 1988 (English Translation).

*Primary Examiner*—Melissa Bonner

*Attorney, Agent, or Firm*—Robert S. Honor; Carl W. Battle; Michael P. Morris

[57] ABSTRACT

Aqueous microemulsions of protonated aminopolysiloxanes (α) comprising an amphoteric surfactant (β) and optionally at least one non-ionic emulsifier (γ) and optionally hydrotropics (δ) and/or cationic emulsifiers (η) and the pH of which is ≦7 are suitable as finishing agents of good stability, in particular stability to shearing forces, for the treatment of fibrous material, in particular textile material.

27 Claims, No Drawings

MICROEMULSIONS OF AMINOPOLYSILOXANES

This is a continuation of application Ser. No. 08/192,227, filed Feb. 4, 1994, now abandoned which in turn is a continuation of application Ser. No. 07/878,790, filed May 5, 1992, which in turn is a continuation of application Ser. No. 07/579,422, filed Sep. 7, 1990, the latter two of which are now abandoned.

For the finishing of substrates, in particular textile material with aminopolysiloxanes a distribution as fine as possible thereof in the treatment liquor is desired and thus aminopolysiloxanes have been emulsified in water by means of particular techniques and/or surfactants to form fine particle-size emulsions to microemulsions. From EP 138 192 A it is e.g. known to produce such microemulsions over an oil concentrate using defined oil-soluble surfactants and by rapid stirring of the oil-concentrates into water the particle size of the obtained emulsion depending on the speed of dispersion. It is known that such emulsions display the deficiencies in type-conformity and heat-stability indicated in EP 358 652 A. From EP 358 652 A it is known to formulate particular aminopolysiloxanes as microemulsions by means of defined hydrosoluble, in particular nitrogen-free, emulsifiers and of acid.

The mentioned microemulsions have a certain stability. In the art, in particular in the field of textile treatment there was, however, still a need for aminopolysiloxane-microemulsions sufficiently stable to shearing forces in order to be stable even at very high dynamic stress of the textile treatment liquor, i.e. in order to maintain their fine distribution in the treatment liquor and consequently their efficiency (e.g. their build-up on the substrate) and in order to avoid silicone deposits caused by destabilisation on the treated goods (which lead to the feared silicone spots) and on parts of the assembly (which impair the treated goods by silicone-stainings as well as the good working of the assembly and requires an uneconomic cleaning of the assembly).

It has now surprisingly been found that by employing amphoteric—in particular nitrogen-containing—surfactants (β), as defined below, and adjusting the pH-value as indicated below, there may be obtained aqueous aminopolysiloxane microemulsions of high stability to shearing forces, in particular as described below.

The invention refers to aqueous emulsifier-containing microemulsions of aminopolysiloxanes, as defined below, their production and their use.

The invention, thus, provides an aqueous microemulsion of an aminopolysiloxane (α) which is characterized by a content of an amphoteric surfactant (β) and a pH ≦7.

The term microemulsion is used here in the most general meaning of the word and encompasses liquid systems in which the components are distributed in the continuous phase so finely that they represent clear two-phase systems up to colloidal solutions. As microemulsions there are understood here in particular such that are translucent to transparent (light-transmitting to optically clear), essentially such with an average particle diameter (numerical average) of the dispersed particles ≦0.2 μm, preferably ≦0.1 μm, principally wherein the particle diameter of the dispersed particles is preponderantly ≦0.2 μm, preferably ≦0.1 μm.

As aminopolysiloxanes (α) are suitable in general any aminopolysiloxanes of polycationic character, essentially such that are built-up of repeating dimethylsiloxy units and aminosiloxy units (in particular aliphatic aminosiloxy units in which the amino groups are bound over carbon to Si). They may have a linear structure or even a branched and/or cross-linked structure. The terminal groups may contain a reactive substituent, e.g. —OH, or optionally be blocked; a preferred blocking terminal group is the trimethylsiloxy group.

The aminopolysiloxanes to be employed according to the invention are preferably built-up of repeating units of the following formulae

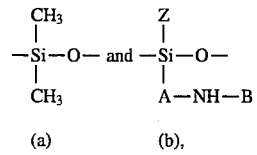

(a) (b), wherein

A signifies a bivalent hydrocarbon radical with 2–6 carbon atoms,

B signifies hydrogen $C_{1-4}$—alkyl or —$(CH_2)m$—$NH_2$, m signifies 2 or 3,

Z signifies —$CH_3$ or OX and

X signifies hydrogen, methyl or the link to radicals of formula (c) or (d) specified below or a polysiloxane radical of units (a) and/or (b).

The terminal groups of the aminopolysiloxane chains correspond preferably to formulae (c) and/or (d).

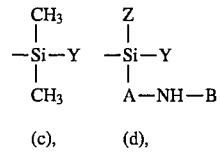

(c), (d), wherein Y signifies methyl, methoxy or hydroxy.

In formulae (b) and (d) A signifies preferably an aliphatic monoethylenically unsaturated or preferably saturated hydrocarbon radical with 3–4 carbon atoms, in particular propylene-1,3 or 2-methyl-propylene-1,3.

B signifies preferably hydrogen, aminoethyl or aminopropyl, in particular aminoethyl.

Z signifies preferably methyl.

The aminopolysiloxanes (α) advantageously have a viscosity in the range of 500–30,000, principally 700–20,000, preferably 5000–15,000 cP (Brookfield rotational viscosimeter RV, spindle no. 5, 20° C.). The amine value of the aminopolysiloxanes (α) is advantageously in the range of 0.1–3.0, preferably 0.3–1.2.

Schematically the aminopolysiloxanes (α) to be used according to the invention may be represented by the following general formula

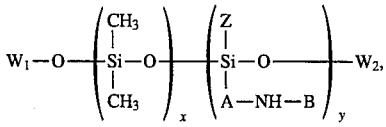

(I)

wherein $W_1$ and $W_2$ signify each a group of formula (c) or (d), the molecule contains at least one group of formula (b) and the indexes x and y are chosen so that the polymer displays the above indicated amine-values and viscosities. The ratio of the number of dimethylsiloxy units to the number of aminosiloxy units, in particular of the formula

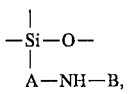

(b')

is advantageously in the range of 3/1 to 300/1, preferably 10/1 to 100/1.

The aminopolysiloxanes may be produced in a manner known per se or analogously to known methods, e.g. by aminoalkylation of polysiloxanes, containing reactive Si-bound hydrogen atoms or principally by copolymerization of amino group-containing silanes with non-ionic mono- or polysiloxanes, preferably with α,ω-dihydroxypolydimethylsiloxanes, advantageously of average molecular weight $\overline{M}_n$ in the range of 500 to 10,000, preferably 1000 to 7000, or cyclic siloxanes, e.g. octamethylcyclotetrasiloxane. As aminosilanes come mainly into consideration aminosubstituted trimethoxysilanes or dimethoxymethylsilanes, wherein the amino group is bound to the silicon atom over carbon and corresponds mainly to the formula —A—NH—B. Preferred radicals —A—NH—B are γ-aminopropyl and γ-(β-amino-ethylamino)-propyl.

Aminoalkylation may take place under conditions known per se and employing conventional aminoalkylation agents.

Copolymerisation may be carried out in a manner known per se, principally by reaction of the reactants at mild or elevated temperature, in particular at temperatures in the range of 15°–180° C., optionally in the presence of a catalyst and, if desired, using terminal blocking groups, e.g. with hexamethyldisiloxane. As catalysts there may be employed acids (in particular acetic acid, formic acid, sulphuric acid, acid ion interchangers or trifluoromethanesulphonic acid) as well as alkali metal or ammonium compounds, in particular alkali metal or ammonium silanolates (e.g. potassium or tetramethylammonium silanolate), alkali metal hydroxides, carbonates or bicarbonates (e.g. potassium hydroxide, sodium hydroxide or sodium bicarbonate) or further benzyltrimethylammoniumhydroxide. If desired, polymerization may be carried out in the presence of an inert solvent that may then be eliminated, e.g. distilled off during polymerization or afterwards.

If for the introduction of the units of formula (b) there is employed an amino group-containing trimethoxysilane the methoxy group Z may, depending on the reaction conditions, be hydrolyzed to the hydroxy group or also take further part in the copolymerisation so that at this site a branching of the copolymer may occur.

Depending on the chosen copolymerisation conditions the amino group-containing units may be statistically distributed throughout the molecule or may be terminal or may be grouped as in block-polymers or even may crowd towards the extremities of the linear chains.

For the microemulsions of the invention those aminopolysiloxanes (α) are preferred that have an optionally branched, prevalently linear structure of the polysiloxane backbone, preferably such in which Z signifies methyl. Further preferred are also those linear polymers that are not terminally blocked, essentially such in which in the groups (c) and (d) Y signifies hydroxy.

As amphoteric surfactants (β) come mainly into consideration such that besides a fatty radical and an anionic group (resp. acid group) contain in the molecule at least one tertiary (in the dipolar form of the ampholyte protonated) amino group or quaternary ammonium group, principally such as described in "Amphoteric Surfactants", Surfactants Science Series, vol. 12 (Bernard R. Bluestein, Clifford L. Hilton, October 28, 1982) and in particular as set out in chapter 1 at pages 2–7, 16–36 and 50–59, in chapter 2 at pages 75–97, 113–119, 122–131, 133–143, 155, 159 and 160 and in chapter 3 at pages 178–203, 209, 219 and 220, of which those are here preferred that are described at pages 30, 31, 77, 78, 87, 197 and 220. Advantageously there are employed as (β) such amphoteric surfactants in which (referred to the non-dipolar form of the ampholyte) the acid group is a carboxylic or sulphonic acid group and the lipophilic radical is bound over a carbamoyl group to the remaining part of the molecule or is the 2-positioned substituent of an amphoteric imidazoline or of the imidazolinium ring of a betaine of the imidazolinium series. Preferably there are employed amphoteric surfactants (β) of the following formulae

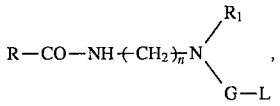

(II)

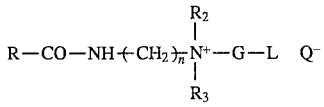

(III)

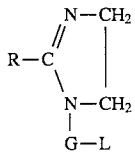

(IV)

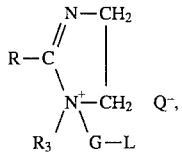

(V)

wherein

R—CO— signifies the radical of a fatty acid with 8–24 carbon atoms, n signifies a number from 2 to 6, $R_1$ signifies hydrogen, $C_{1-4}$-alkyl, benzyl or α-hydroxyethyl or -propyl, $R_2$ signifies $C_{1-4}$-alkyl, $R_3$ signifies $C_{1-4}$-alkyl, benzyl or α-hydroxyethyl or -propyl, G signifies $C_{1-3}$-alkylene or 2-hydroxy-propylene-1,3, L signifies a carboxy- or sulphonic acid group and Q– signifies the counterion to the ammonium cation or mixtures thereof.

R in formulae (IV) and (V) corresponds in its significance to the symbol R in the formulae (II) and (III), i.e. it signifies a corresponding aliphatic hydrocarbon radical with 7–23 carbon atoms.

The quaternary imidazolinium compounds containing, besides the 2-positioned radical R, the N-bound radicals $R_3$ and —G—L may occur optionally also in the isomeric form

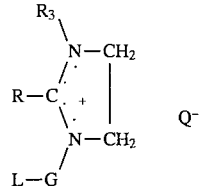

(Vbis)

For the sake of simplicity they will be indicated in the following only with the formula (V).

R—CO— preferably is the radical of an aliphatic fatty acid with 12–18 carbon atoms and may be saturated or unsaturated. The following fatty acid radicals may be mentioned: lauroyl, palmitoyl, myristoyl, oleoyl, stearoyl, behenoyl and arachidoyl as well as the radicals of technical fatty acids, in particular of tallow fatty acid and coconut fatty acid.

$R_1$ advantageously signifies methyl, ethyl or preferably β-hydroxyethyl.

$R_2$ preferably signifies methyl.

$R_3$ advantageously signifies methyl, ethyl or β-hydroxyethyl; in formula (III) preferably methyl and in formula (V) preferably β-hydroxyethyl.

G advantageously signifies methylene, ethylene or propylene-1,3 or 2-hydroxy-propylene-1,3. If L signifies a carboxy group G preferably signifies $C_{1-3}$-alkylene, in particular methylene; if L signifies a sulpho group then G preferably signifies $C_{1-3}$-alkylene or in particular 2-hydroxypropylene-1,3.

The surfactants (β) may be employed in the form of free acids (respectively internal salts) or preferably as salts in which L signifies —COOM or —$SO_3M$ and M signifies a cation. Preferably M is an alkali metal cation (in particular lithium, sodium or potassium).

As counterion $Q^-$ come into consideration in general conventional counterions as are formed in cyclization or quaternization reactions, principally the anion of a mineral acid (e.g. chloride or sulphate) or, in particular in formula (III), advantageously also for methosulphate or ethosulphate, depending on the employed quaternization agent. Surfactants of formula (II) in which n signifies 2 may be reacted to such of formula (IV) by cyclization reactions and, vice versa, surfactants of formula (IV) may be hydrolyzed to such of formula (II) in which n signifies 2.

In the microemulsions of the invention there are employed advantageously 5–60, preferably 10–40, in particular 15–35 parts by weight of amphoteric surfactant (β) for every 100 parts by weight of aminopolysiloxane (α).

The microemulsions of the invention have a pH of 7 or less which may be adjusted by acid addition, and the aminopolysiloxanes (α) are present in the microemulsions of the invention at least in part in protonated form. The pH values of the compositions of the invention are advantageously in the range of pH 2–5, preferably 3–5.

As acids (ε) that may be employed for setting the pH, any sufficiently strong acids are suitable, preferably ($\epsilon_1$) aliphatic carboxylic acids with 1–8 carbon atoms, in particular simple carboxylic acids with 1–6, preferably 1–4 carbon atoms (principally formic acid, acetic acid, propionic acid and butyric acid), dicarboxylic acids with 2 to 6 carbon atoms (principally oxalic acid, succinic acid, glutaric acid and adipic acid) and hydroxy-carboxylic acids with 3–8, preferably 3–4, carbon atoms (principally lactic acid, tartaric acid, citric acid, gluconic acid and glucoheptic acid), and stronger acids ($\epsilon_2$) preferably mineral acids (in particular hydrochloric acid, sulphuric acid or phosphoric acid) and stronger organic acids (in particular trichloroacetic acid and trifluoromethane sulphonic acid).

Of the acids ($\epsilon_1$) formic acid and acetic acid are preferred. Of the acids ($\epsilon_2$) sulphuric acid and hydrochloric acid are preferred.

The microemulsions of the invention advantageously contain at least one non-ionic emulsifier (γ).

Suitable non-ionic emulsifiers (γ) are in particular such with an HLB value in the range of 5–16. The emulsifiers (γ) may be of aliphatic and optionally also aromatic character, preferably they are, however, purely aliphatic. Particularly worth mention are sorbitemonoesters of $C_{8-16}$- (preferably $C_{11-14}$-) fatty acids and oxyethylation products of fatty alcohols or of fatty acid amides, wherein the fatty radical advantageously contains 8–22 carbon atoms, preferably 10–18 carbon atoms. Besides ethyleneoxy units there may optionally also be an amount, in particular a minor amount of propyleneoxy units built-in in the non-ionic surfactant. There may be mentioned in particular oxyethylation products of the following fatty alcohols and fatty acid amides: lauryl alcohol, myristyl alcohol, cetyl alcohol, oleyl alcohol, stearyl alcohol and technical alcohols, in particular tallow fatty alcohol and coconut fatty alcohol, as well as the analogous fatty acid amides, and little or highly branched primary or secondary synthetic alcohols from the oxosynthesis—e.g. from propylene— of which those with 10–15 carbon atoms are preferred, mainly trimethylnonanol, tetramethylnonanol and tetramethyldecanol, in particular the primary isotridecylalcohol, tetramethylnonanol-1; among the sorbite fatty acid esters sorbitan monolaurate is particularly preferred. The degree of oxyethylation is suitably chosen so that the desired HLB is achieved. It is of particular advantage to use two different emulsifiers (γ) viz. mainly non-ionic emulsifiers ($\gamma_1$) with a lower HLB-value, advantageously a HLB-value in the range of 5–12, preferably 6–12, and emulsifiers ($\gamma_2$) of higher HLB-value, advantageously in the range of 10–16, preferably 12–16, the HLB-value of ($\gamma_2$) being higher than the one of ($\gamma_1$) advantageously by at least one unit, preferably by at least 2 units.

The HLB-values of the oxyethylation products may be calculated by means of the known formula HLB=E/5 (E=% by weight of ethyleneoxy in the molecule).

For every 100 parts by weight of the aminopolysiloxane (α) there are employed advantageously 10 to 60; preferably 15 to 50 parts by weight of non-ionic emulsifier (γ) resp. of the non-ionic emulsifier mixture ($\gamma_1$)+($\gamma_2$). The weight ratio ($\gamma_1$): ($\gamma_2$) is advantageously in the range of 1:9 to 9:1, principally 1.5:8.5 to 8.5:1.5, preferably 4:6 to 6:4.

Hydrotropics (δ) may, if desired, be employed, especially if as ($\gamma_1$) there are employed emulsifiers with an HLB>10.

As (δ) are suitable, in general, known advantageously aliphatic low molecular compounds, preferably non-ionic C/H/O-compounds, in particular with 2–24 carbon atoms, principally aliphatic alcohols and/or ethers with 4–18, in particular 4–12 carbon atoms. Preferred hydrotropics are polyols [in particular 1,3-butanediol, neopentyl glycol, pentaerythrite, 1,1,1-tris(hydroxymethyl)-ethane or -propane, 2,5-hexanediol and 2-methyl-pentane-2,4-diol], oligoalkylene glycols and their alkylethers [principally di-, tri- tetra-, penta- and hexaethylene glycol and mono- or di- -($C_{1-6}$-alkyl)-ethers thereof, in particular di-, tri- or tetraethylene glycol monobutylether and bis-(2-hydroxypropyl)-ether, and dipropylene glycol] and glucosides that are etherified with $C_{1-6}$-alkyl at the anomeric hydroxy group (preferably butylglucoside).

For every 100 parts by weight of (α) there are employed advantageously up to 60 parts by weight, advantageously up to 50 parts by weight, in particular 5–50 parts by weight of (δ).

The aqueous microemulsions of the invention contain advantageously up to 70% by weight, principally 15–70% by weight, preferably 20–60% by weight, in particular 30–50% by weight of the total of components [(α)+(β)+(γ)+(δ)], the content of (δ) being 0–60% by weight, referred to (α).

According to a preferred aspect of the invention the microemulsions of the invention contain at least one cationic surfactant (η). As cationic surfactants (η) come into consideration principally ammonium compounds that contain at least one lipophilic radical which is advantageously an aliphatic fatty radical with 8–24 carbon atoms, the molecule containing preferably not more than one such lipophilic radical per ammonium group. As cationic surfactant (η) come into consideration preferably such of the following formula

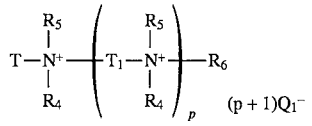

(VI)

in which

T signifies a radical of formula R'—$CH_2$—, R'—CO—NH—T'—or R'—$CH_2$—O—T"—,

R' signifies an aliphatic hydrocarbon radical with 7–23 carbon atoms, $T_1$ signifies $C_{2-6}$-alkylene, T' signifies $C_{2-6}$-alkylene, T" signifies $C_{2-6}$-alkylene or —$CH_2$—CHOH—$CH_2$—, each $R_4$ independently signifies $C_{1-4}$-alkyl or a radical of formula —($CH_2$—$CH_2$—O)$_q$—H, each $R_5$ independently signifies hydrogen or $C_{1-4}$-alkyl, $R_6$ signifies $C_{1-4}$-alkyl, a radical of formula —($CH_2$—$CH_2$—O)$_q$—H or T, p signifies a number from 1 to 2, each q signifies at least 1, and $\Sigma q<70$ and $Q_1^-$ signifies a counterion to the ammonium cation.

If in formula (VI) $R_5$ signifies hydrogen, there may be employed advantageously the corresponding protonatable free bases of formula

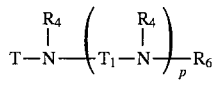

(VII)

which may then be protonated at latest when adjusting the pH-value to pH ≦7.

The radical R' contains advantageously 11–21 carbon atoms. As radicals R'—$CH_2$— mainly the following come into consideration: lauryl, palmityl, cetyl, oleyl, stearyl, behenyl, arachidyl, tallow alkyl or cocoalkyl of which those with 12–18 carbon atoms are preferred. As radicals R'—CO— come into consideration, in particular, the acyl radicals of the corresponding fatty acids, e.g. as indicated above for R—CO—.

$T_1$ and T' signify preferably $T_2$, i.e. ethylene or propylene, of which propylene-1,3 is particularly preferred.

T" signifies preferably ethylene, propylene or 2-hydroxypropylene-1,3.

T signifies preferably $T_0$, i.e. R'—$CH_2$— or R'CO—NH—T'—.

In a preferred subgroup ($\eta_1$) of the cationic surfactants (η)

$R_4$ signifies $R'_4$, i.e. methyl or ethyl, $R_5$ signifies $R_5'$, i.e. $C_{1-4}$-alkyl preferably methyl or ethyl, $R_6$ signifies $R_6'$, i.e. $C_{1-4}$-alkyl, preferably methyl or ethyl and the index p signifies p', i.e. 0 or 1, preferably 0, $Q_1^-$ being any conventional anion, in particular as is formed by quaternization, e.g. as indicated above for $Q^-$.

In a further preferred subgroup ($\eta_2$) of the cationic surfactants (η)

$R_4$ signifies $R_4$", i e a radical of formula —($CH_2$—$CH_2$—O)$_{q1}$—H, $R_5$ signifies hydrogen, $R_6$ signifies $R_6$", i.e. a radical of formula —($CH_2$—$CH_2$—O)$_{q1}$—H, p signifies p", i.e. 0 or 1 and q signifies q1, i.e. at least 2 and $\Sigma q_1$=5–40, preferably 8–20, $Q_1^-$ signifying a counterion as is formed by protonation, in particular as is formed by addition of acids (ε).

Preferred amines of formula (VII) correspond to formula

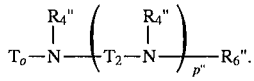

(VIII)

The quaternary surfactants ($\eta_1$) correspond advantageously to the formula

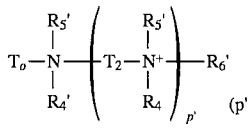

(IX)

preferably to the formula

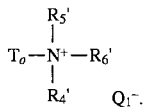

(X)

As cationic surfactants (η) there are employed preferably quaternary compounds ($\eta_1$) advantageously of formula (IX), preferably of formula (X), which may advantageously be blended with ($\eta_2$) resp. with the protonatable amines of formula (VII), preferably of formula (VIII). If ($\eta_1$) is blended with ($\eta_2$) or in particular with protonatable amines of formula (VII) resp. (VIII) the weight ratio of ($\eta_1$) to ($\eta_2$) [the latter calculated as protonatable free base of formula (VII)], preferably of surfactant of formula (IX) or (X) to surfactant of formula (VIII), is advantageously in the range of 1/2 to 5/1, preferably 1/1 to 3/1.

The surfactants (η) are employed with particular advantage when employing surfactants ($\gamma_1$), in particular such of HLB≦9, preferably HLB=5–9 and/or oil-soluble surfactants ($\gamma_1$), the surfactants being designated here as oil-soluble if at least 1 g thereof gives in 20 g of a clear aminopolysiloxane (α) [in the form of the free base or in a form protonated with (ε)] at 2° C. a clear solution.

For every 100 parts by weight of (α) there are employed advantageously up to 30, preferably 8 to 20 parts by weight of (η). The total of [(α)+(β)+(γ)+(δ)+(η)] in the microemulsions of the invention is advantageously in the range of 15 to 70% by weight, principally 20 to 60% by weight, preferably 30 to 50% by weight, the content of (δ) being 0–60% by weight and the content of (η) being 0–30% by weight.

The microemulsions of the invention may be prepared by admixing of the respective components for which (β) may be added to the non-protonated or to the protonated form of (α) and, if required, after the addition of (β) the pH is adjusted to the desired value. The setting of the required or desired acidic pH-values takes place suitably by means of acid addition, preferably by addition of (ε), in particular ($\epsilon_1$) and/or ($\epsilon_2$).

The adjustment of the pH-value may take place in one or even stages, i.e. by means of one or more acid additions. Preferably the pH is set first with ($\epsilon_1$) to a value e.g. in the range of pH 3–7, advantageously to a weakly acidic to neutral pH, preferably 6–7; the final pH, preferably in the range of 2–5, in particular 3–5, is preferably set with ($\epsilon_2$). It is, however, also possible to operate only with ($\epsilon_1$) or only with ($\epsilon_2$).

The microemulsions of the invention are preferably produced by addition of ($\beta$) and preferably ($\gamma$) [in particular ($\gamma_1$) and ($\gamma_2$)] and optionally ($\delta$) and/or ($\eta$) and of the required quantity of water and acid ($\epsilon$) to ($\alpha$). The sequence of the additions is in general discretionary, so long as the respective mixtures are well stirrable. Thus, ($\alpha$) may for instance be admixed first with ($\gamma_1$) or with ($\delta$) or with a mixture of ($\gamma_1$) and ($\delta$) and then be further admixed with the remaining components either sequentially or as mixtures [e.g. ($\gamma_2$)+($\beta$), or ($\gamma_1$)+($\gamma_2$)+($\beta$)] or ($\gamma_1$)+($\gamma_2$)+($\beta$) and optionally ($\delta$) and/or ($\epsilon_1$) may be given together into ($\alpha$). Water and acid ($\epsilon_1$) may be added separately or together with the respective components. ($\eta$) may be added in any stage, advantageously after the other surfactants and preferably after ($\epsilon$). Advantageous sequences of additions of the components ($\beta$), ($\gamma_1$), ($\gamma_2$), ($\epsilon_1$) and ($\epsilon_2$) to ($\alpha$) may be represented by means of the following Scheme 1

SCHEME 1

| 1. | 2. | 3. | 4. | 5. |
|---|---|---|---|---|
| $\alpha$ | $\gamma_1$ | $\gamma_2$ | $\beta$ | $\epsilon_2$ |
| $\alpha$ | $\gamma_1$ | $\gamma_2 + \beta$ | $\epsilon_2$ | |
| $\alpha$ | $\gamma_1 + \gamma_2$ | $\beta$ | $\epsilon_2$ | |
| $\alpha$ | $\gamma_1 + \gamma_2 + \beta$ | $\epsilon_2$ | | |

in which ($\epsilon_1$) may be added in any one or more of the stages 1 to 5 and/or in the intermediate stages between 1 and 2, 2 and 3, optionally 3 and 4 and optionally 4 and 5, ($\delta$), so long as it is added, may be added in any one or more of the stages 1 to 5 and/or of the intermediate stages between 1 and 2, 2 and 3, optionally 3 and 4 and optionally 4 and 5 and/or after the addition of ($\epsilon_2$).

The required water may be added separately or together with one or more of the components, advantageously with ($\beta$), ($\gamma_2$) and/or ($\delta$). ($\alpha$) is advantageously added in the form of aqueous composition. Advantageous variants in the sequence of the additions are in particular the following:

Variant a): adding to ($\alpha$) first ($\gamma_1$) then [($\gamma_2$)+water], then ($\beta$) and then ($\epsilon_2$)

with the following subvariants for the addition of ($\epsilon_1$):

$a_1$): addition of ($\epsilon_1$) before ($\gamma_1$), $a_2$): addition of ($\epsilon_1$) between ($\gamma_1$) and ($\gamma_2$) or together with ($\gamma_1$) and ($\gamma_2$), $a_3$): addition of ($\epsilon_1$) between ($\gamma_2$) and ($\beta$) or together with ($\beta$), a4): addition of ($\epsilon_1$) after ($\gamma_1$), ($\gamma_2$) and ($\beta$), and the following further subvariants for the addition of ($\delta$):

$a_{w1}$): ($\delta$) before or together with ($\gamma_1$), $a_{w2}$): ($\delta$) before or together with ($\gamma_2$), $a_{w3}$): ($\delta$) before or together with ($\beta$), $a_{w4}$): ($\delta$) after ($\beta$) and before ($\epsilon_2$), $a_{w5}$): ($\delta$) after ($\epsilon_2$)

wherein w=1, 2, 3 or 4;

a further subvariant is ($a_{w41}$) for the further addition of residual ($\gamma_1$) simultaneously with/or after ($\beta$) and before ($\epsilon_2$).

Variant b): adding to ($\alpha$) first ($\gamma_1$) then [($\gamma_2$)+($\beta$)+water] and then ($\epsilon_2$)

with the following subvariants for the addition of ($\epsilon_1$):

$b_1$): ($\epsilon_1$) before ($\gamma_1$), $b_2$): ($\epsilon_1$) between ($\epsilon_1$) and [($\epsilon_2$)+($\beta$)+water] or simultaneously with ($\gamma_1$) or [($\gamma_2$)+($\beta$)+water], $b_3$): ($\epsilon_1$) after [($\gamma_2$)+water] and before the addition of ($\epsilon_2$ ) or in admixture with ($\epsilon_2$ ), with the following further subvariants for the supplementary addition of ($\epsilon$):

$b_{w1}$): ($\delta$) before ($\gamma_1$), $b_{w2}$): ($\delta$) between ($\gamma_1$) and [($\gamma_2$)+($\beta$)+water] or together with ($\gamma_1$) or [($\gamma_2$)+($\beta$)+water], $b_{w3}$): ($\delta$) after [($\gamma_2$)+($\beta$)+water], (w=1, 2 or 3).

Variant c): adding to ($\alpha$) a mixture of ($\gamma_1$)+($\gamma_2$)+($\alpha$) and thereafter ($\epsilon_2$)

with the following subvariants for the addition of ($\epsilon_1$):

$c_1$): ($\epsilon_1$) before [($\gamma_1$)+($\gamma_2$)+($\beta$)], $c_2$): ($\epsilon_1$) together with [($\gamma_1$)+($\gamma_2$ )+($\beta$)], $c_3$): ($\epsilon_1$) after [($\gamma_1$)+($\gamma_2$)+($\beta$)] and before ($\epsilon_2$), and the following further subvariants for the supplementary addition of ($\delta$):

$c_{w1}$): ($\delta$) before [($\gamma_1$)+($\gamma_2$)+($\beta$)], $C_{w2}$): ($\delta$) simultaneously with [($\gamma_1$)+($\gamma_2$)+($\beta$)], $c_{w3}$): ($\delta$) after [($\gamma_1$)+($\gamma_2$)+($\beta$)] and before ($\epsilon_2$), (w=1, 2 or 3).

($\eta$) may be added in any stage, advantageously after the addition of ($\beta$), preferably after the addition of ($\epsilon_2$). The required water and optionally additionally required water may be added in one or more stages, e.g. when following variant c), together with ($\gamma_1$), ($\gamma_2$) and ($\beta$) and/or after the addition of ($\gamma_1$), ($\gamma_2$) and ($\beta$) before or simultaneously with the addition of ($\epsilon_1$).

Particularly convenient sequences of the additions of ($\beta$), ($\gamma_1$), ($\gamma_2$), ($\epsilon$) [optionally subdivided into ($\epsilon_1$) and ($\epsilon_2$)] and optionally (6) and/or ($\eta$) [optionally subdivided into ($\eta_1$) and ($\eta_2$)] may be represented by means of the following Scheme 2

SCHEME 2

| 1. | 2. | 3. | 4. | 5. | 6. | 7. |
|---|---|---|---|---|---|---|
| $\alpha$ | $\gamma_1$ | $(\beta + \gamma_2)^1$ | $\delta$ | $\epsilon_1$ | $\epsilon_2$ | $(\eta_1 + \eta_2)^2$ |
| $\alpha$ | $\gamma_1$ | $(\beta + \gamma_2 + \delta)^1$ | $\epsilon_1$ | $\epsilon_2$ | $(\eta_1 + \eta_2)^2$ | |
| $\alpha$ | $\gamma_1$ | $(\beta + \gamma_2 + \delta + \epsilon_1)^1$ | $\epsilon_2$ | $(\eta_1 + \eta_2)^2$ | | |
| $\alpha$ | $\gamma_1 + \gamma_2$ | $\beta^1$ | $\delta$ | $\epsilon_1$ | $\epsilon_2$ | $(\eta_1 + \eta_2)^2$ |
| $\alpha$ | $\gamma_1 + \gamma_2$ | $(\beta + \delta)^1$ | $\epsilon_1$ | $\epsilon_2$ | $(\eta_1 + \eta_2)^2$ | |
| $\alpha$ | $\gamma_1 + \epsilon_1$ | $(\beta + \gamma_2)^1$ | $\delta$ | $\epsilon_2$ | $(\eta_1 + \eta_2)^2$ | |
| $\alpha$ | $\gamma_1 + \epsilon_1$ | $(\beta + \gamma_2 + \delta)^1$ | $\epsilon_2$ | $(\eta_1 + \eta_2)^2$ | | |
| $\alpha$ | $\gamma_1 + \delta$ | $(\beta + \gamma_2)^1$ | $\epsilon_1$ | $\epsilon_2$ | $(\eta_1 + \eta_2)^2$ | |
| $\alpha$ | $\delta$ | $(\beta + \gamma_1 + \gamma_2)^1$ | $\epsilon_1$ | $\epsilon_2$ | $(\eta_1 + \eta_2)^2$ | |
| $\alpha$ | $\gamma_1 + \gamma_2 + \beta$ | $\delta^1$ | $\epsilon_1$ | $\epsilon_2$ | $(\eta_1 + \eta_2)^2$ | |
| $\alpha$ | $(\beta + \gamma_1 + \gamma_2 + \delta)^1$ | $\epsilon_1$ | $\epsilon_2$ | $(\eta_1 + \eta_2)^2$ | | |

-continued

SCHEME 2

| 1. | 2. | 3. | 4. | 5. | 6. | 7. |
|---|---|---|---|---|---|---|

[1]Together with the main quantity of water
[2]As aqueous solution

By admixing of components (α), (β), ($\gamma_1$) and ($\gamma_2$) and water as well as optionally (δ) there may be formed, in particular under neutral to basic conditions, even at elevated temperatures, opaque emulsions (macroemulsions) which, however, upon acid addition—even only addition of ($\epsilon_1$)—can be transformed into light-transmitting to clear microemulsions. If the form of (α) protonated with (ε) is used from the beginning, a microemulsion may already be formed by mixing-in of ($\gamma_1$), ($\gamma_2$) and water.

The addition of the respective components may take place at any suitable speed, i.e. an optionally aqueous component or an optionally aqueous component mixture may be added rapidly and with quick stirring within a few minutes or, simplest, be mixed-in slowly during one or more quarters of an hour (e.g. during half an hour to two hours). The admixing of the components may be carried out at any suitable temperatures, e.g. in the range of 15° C. to reflux temperature, advantageously from room temperature (=20° C.) to 80° C., temperatures <50° C. being also well suitable.

The microemulsions of the invention, in particular those produced as described above, are suitable as finishing agents for fibrous material and may, so as they are formulated, be directly employed for the formulation of the application liquor or may, if required, be diluted with water to more diluted stock dispersions, e.g. up to a dry substance content of 2–4% by weight before application from aqueous medium. The aqueous compositions of the invention may if desired contain further additives, such as perfumes or fungicides. They are suitable for finishing fibrous material, in particular textile material from aqueous medium, in particular in order to improve their handle and gliding properties.

Any textile material as occurs in textile industry is suitable, viz. as well as natural as synthetic and semi-synthetic materials and their mixtures, in particular natural or regenerated cellulose, natural or synthetic polyamide, polyester-, polyurethane- or polyacrylonitrile-containing material and mixtures thereof (e.g. PES/CO and PAN/CO). The material may be in any processing form, i.e. as loose fibers, filaments, threads, yarn skeins and spools, woven goods, knitted goods, non-bonded or bonded non-wovens, felts, carpets, velvet, tufting or even as half-ready or ready-made goods. Preferred substrates are cross-wound spools, open width or tubular textiles (in particular tubular knittings) or piece-goods. Finishing takes place suitably from aqueous clearly acidic to nearly neutral medium, in particular in the pH range of 3.0–7.5. The concentration of composition of the invention, referred to the substrates, may vary broadly, depending on the kind and constitution of the substrate and on the desired effect, and is advantageously—calculated on component (α)—in the range of 0.1–1, preferably 0.2–0.6% of aminopolysiloxane (α), referred to the dry weight of the substrate.

The finishing process of the invention is carried out advantageously as the last finishing step of the material, preferably upon a bleaching, an optical brightening process and/or a dyeing process, optionally simultaneously with a further treatment, e.g. as permanent finishing (synthetic resin size) of the fibrous material. The finishing may be carried out according to any methods conventional per se, e.g. by impregnation or exhaust methods. For exhaust methods procedure from long or also short liquors may come into consideration, e.g. at liquor-to-goods ratios of 1:100 to 1:0.5, in particular between 1:60 to 1:2; the application temperature may range in conventional values, e.g. in the range between room temperature and 60° C. preferably in the range of 25–40° C.; the pH value is preferably in the range of 4–6. Also impregnation may be carried out according to methods conventional per se, e.g. by dipping, padding, foam application or spraying, preferably at temperatures of 15°–40° C. and at pH values in the range of 3.5–7. After the impregnation resp. after the exhaust procedure, the treated goods may be dried in conventional way, e.g. at 30°–180° C., preferably 60°–140° C.

The microemulsions of the invention are distinguished by an outstanding stability (in particular shear stability) and the application liquors are stable and of unchanged efficiency, even under strong dynamic stress of liquor and/or textile material; they are therefore suitable, e.g. for the finishing in the winch beck, in the jigger, in yarn-dyeing assemblies, in garment-dyeing machines and in particular also in jet-dyeing machines, even in those in which extremely high shearing forces arise (also bound and rebound forces). The compositions of the invention are also very well suitable for the wet-finishing of cross-wound spools; also in this case the strong dynamic stress of the liquor which is forced from the inner of the spool outwards through the yarns of the cross-wound spool, has practically no negative effect on the compositions of the invention and on the finishing obtained therewith. The compositions of the invention—in particular the (η)—containing ones—when added to the treatment liquors, are also stable to impurities which may derive, e.g. in the form of residues, from a preceding treatment of the substrates, in particular anionic impurities, e.g. dyestuffs, optical brighteners or surfactants.

In the following examples parts and percentages are by weight, the temperatures are indicated in degrees Celsius, parts by weight relate to parts by volume as g to ml.

The employed surfactants (β) are the following:

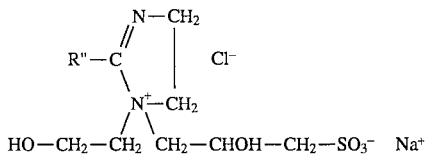

(β1)

-continued

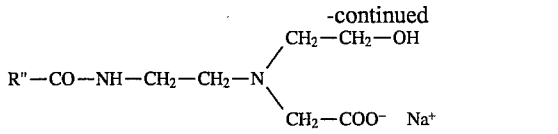

(β2)

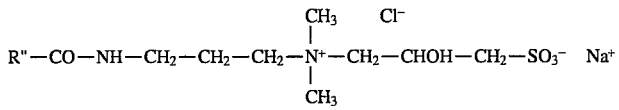

(β3)

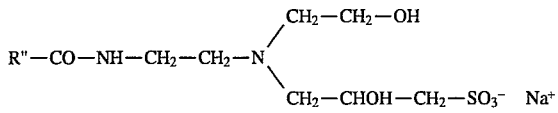

(β4)

in which R"—CO— signifies oleoyl and R" in ($\beta_1$) has the same significance ($C_{17}H_{33}$) as in ($\beta_2$), ($\beta_3$) an ($\beta_4$).

The employed emulsifiers ($\gamma_1$) and ($\gamma_2$) are the following:

($\gamma_{11}$) addition product of 4 moles of ethyleneoxide to 1 mole of technical isotridecylalcohol*

($\gamma_{12}$) addition product of 5 moles of ethyleneoxide to 1 mole of technical isotridecylalcohol*

($\gamma_{13}$) addition product of 6 moles of ethyleneoxide to 1 mole of 2,6,8-trimethylnonanol-4 (Tergitol TMN-6, UNION CARBIDE)

($\gamma_{14}$) addition product of 3 moles of ethyleneoxide to 1 mole of $C_{11-15}$)-alcanol (Tergitol 15-S-3)

($\gamma_{15}$) sorbitanemonolaurate ($\gamma_{21}$) addition product of 9.5 moles of ethyleneoxide to 1 mole of technical isotridecylalcohol*.

* technical isomeric mixture from the oxosynthesis

The employed surfactants ($\eta_1$) and ($\eta_2$) are the following:

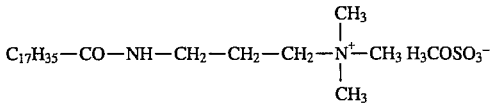

($\eta_{11}$)

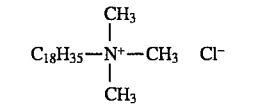

($\eta_{12}$)

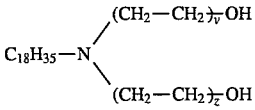

($\eta_{21}$)

in which $C_{17}H_{35}$—CO— signifies the stearoyl radical, $C_{18}H_{35}$ signifies the oleyl radical and w+z=15.

EXAMPLE 1

(Products A, B, C and D)

185.4 parts of α,ω-Dihydroxypolydimethylsiloxane with a hydroxy value of 26 (determined by means of the phenylisocyanate method) and an average molecular weight $\overline{M}_n$ of 5000 (determined by means of vapor-pressure osmometry) are admixed with brief stirring with 12.2 parts of N-(β-amino-ethyl)-γ-(methyldimethoxysilyl)-propylamine. 2.4 parts of glacial acetic acid are then added and the mixture is heated under a nitrogen blanket to 75° C. After 5 hours at this temperature the mixture is cooled to 50° C., the nitrogen feed is stopped and 30 parts of ($\gamma_{21}$) are added. 480.5 parts of a solution of 30 parts of ($\gamma_{21}$) in 450.5 parts of water are subsequently added dropwise during 1 hour. When about 140.0 parts of the aqueous solution have been added the emulsion becomes transparent. At 30° C. are then added 3.5 parts of acetic acid and (for Product A) 120 parts of a 50% aqueous solution of ($\beta_1$)

or (for Product B) 120 parts of a 50% aqueous solution of ($\beta_2$)

or (for Product C) 120 parts of a 50% aqueous solution of ($\beta_3$)

or (for Product D) 120 parts of a 50% aqueous solution of ($\beta_4$).

The pH is then adjusted to 4.0 by addition of hydrochloric acid of 36.5% concentration. There are obtained transparent aminopolysiloxane microemulsions which are stable to shearing forces.

EXAMPLE 2

(Product E)

188.70 parts of α,ω-dihydroxypolydimethylsiloxane (as in Example 1) are admixed with stirring with 12.50 parts of N-(β-aminoethyl)-γ-(methyl-dimethoxysilyl)-propylamine and treated with 0.07 parts of a 50% sodium hydroxide solution. The mixture is subsequently heated to 112° C. under a nitrogen blanket, 1 part by volume of distillate being collected. After 3½ hours the mixture is cooled to 40° C. As soon as this temperature is reached 0.02 parts of sodium bicarbonate are added and the mixture is heated to 110° C. with vacuum (at 70 mbar). After cooling to 50° C. and relaxing with nitrogen 30 parts of ($\gamma_{12}$) are added. 480 parts of a solution of 30 parts of ($\gamma_{21}$) in 450 parts of water are subsequently added dropwise during 1 hour. 3 parts of glacial acetic acid, 100 parts of a 50% aqueous solution of ($\beta_4$), 147 parts of water, 20 parts of ($\gamma_{13}$) are then further added and the pH-value is adjusted to 4.0 by addition of about 20 parts of 36.5% hydrochloric acid. There is obtained an aminopolysiloxane microemulsion (Product E) stable to shearing forces.

EXAMPLE 3

(Product F)

200.0 parts of an aminopolysiloxane obtained by condensation of 600.0 parts of α,ω-dihydroxypolydimethylsiloxane (as in Example 1) and 39.6 parts of N-(β-aminoethyl)-γ-(methyldimethoxysilyl)-propylamine with addition with 7.7 parts of glacial acetic acid as a catalyst are treated at 50° C. with 30 parts of ($\gamma_{11}$) and 20 parts of butylmonoglucoside. 480.5 parts of a solution of 30 parts of ($\gamma_{21}$) in 450.5 parts of water are subsequently added dropwise during 1 hour. 120 parts of a 50% aqueous solution of ($\beta_4$) 138.5 parts of water and 11.0 parts of formic acid are then further added. There is obtained an aminopolysiloxane microemulsion (Product F) which is stable to shearing forces.

EXAMPLE 4

(Product G) 200.0 parts of an aminopolysiloxane obtained by condensation of 600.0 parts of α,ω-dihydroxypolydimethylsiloxane (as in Example 1) and 39.6 parts of N-(β-aminoethyl)-γ-(methyldimethoxysilyl)-propylamine with addition of 7.7 parts of glacial acetic acid are treated at 50° C. with 30 parts of ($\gamma_{11}$). 480.5 parts of a solution of 30 parts ($\gamma_{21}$ ) in 450.5 parts of water are subsequently added dropwise during 1 hour. 3.7 parts of glacial acetic acid, 120.0 parts of a 50% aqueous solution of ($\beta_4$), 87.8 parts of water, 18.0 parts of 36.5% hydrochloric acid (for adjustment of the pH-value to 4.0) and 60.0 parts of dipropylenegylcol are further added sequentially. There is obtained an aminopolysiloxane microemulsion (Product G) which is stable to shearing forces.

EXAMPLE 5

(Product H) 300.00 parts of α,ω-dihydroxypolydimethylsiloxane with a hydroxy value of 26 (determined by means of the phenylisocyanate method) and an average molecular weight $\overline{M}_n$ of 5000 (determined by means of vapor-pressure osmometry) are heated together with 19.80 parts of N-aminoethyl-aminopropyl-methyldimethoxysilane and 3.84 parts of glacial acetic acid under vacuum to 75° C. until there is obtained a BROOKFIELD rotational viscosity in the range 30,000–40,000 cP. 3.58 parts of potassium hydroxide dissolved in 5.38 parts of water are then added and reaction is continued at 75° C. under a nitrogen blanket until a BROOKFIELD rotational viscosity in the range of 7000–9000 cP is achieved. At this point the heating and the nitrogen feed are stopped and 49.00 parts of ($\gamma_{14}$) are added. An aqueous solution consisting of 762.15 parts of water 49.00 parts of ($\gamma_{21}$)

195.9 parts of a 50% aqueous solution of ($\beta_4$)

and 130.64 parts of an 80% aqueous butylmonoglucoside solution is added in a regular flow. About 13.00 parts of glacial acetic acid and 25 parts of 36.5% hydrochloric acid are further added in order to adjust the pH-value to 4.0. There is obtained a transparent product that is further treated with 16.33 parts of ($\eta_{21}$) and 26.65 parts of ($\eta_{11}$) dissolved in 11.76 parts of water and 26.91 parts of dipropyleneglycol. There are obtained 1633.00 parts of Product H with good stability to shearing forces.

EXAMPLE 6

(Product J)

The procedure of Example 5 is repeated up to the stopping of the heating and the nitrogen feed. At this point there are added 16.33 parts of ($\gamma_{14}$) and 32.67 parts of ($\gamma_{15}$). An aqueous solution consisting of 745.81 parts of water 49.00 parts of ($\gamma_{21}$)

195.96 parts of a 50% aqueous solution of ($\beta_4$)

and 130.64 parts of an 80% aqueous butylmonoglucoside solution are then added in a regular flow. About 13.00 parts of glacial acetic acid and 25.00 parts of 36.5% hydrochloric acid are then further added in order to adjust the pH to 4.0. There is obtained a transparent product which is further treated with 39.98 parts of ($\gamma_{11}$) dissolved in 17.64 parts of water and 40.37 parts of dipropylenglycol. There are obtained 1633.00 parts of Product J with a good stability to shearing forces.

EXAMPLE 7

(Product K)

The procedure of Example 5 is repeated up to the addition of ($\gamma_{14}$). An aqueous solution consisting of 729.48 parts of water 49.00 parts of 195.96 parts of a 50% aqueous solution of ($\beta_4$)

and 130.64 parts of dipropyleneglycol are added in a regular flow. About 13.00 parts of glacial acetic acid and 25.00 parts of 36.5% hydrochloric acid are then further added in order to adjust the pH to 4.0. There is obtained a transparent product which is further treated with 16.33 parts of ($\eta_{21}$) and 39.98 parts of ($\eta_{11}$) dissolved in 17.64 parts of water and 40.37 parts of dipropyleneglycol. There are obtained 1633.00 parts of Product K with a good stability to shearing forces.

EXAMPLE 8

(Product L)

Example 7 is repeated with the difference that in place of dipropyleneglycol there is employed 1,3-butanediol.

EXAMPLES 6bis, 7bis and 8bis (Products J', K' and L')

Examples 6, 7 resp. 8 are repeated with the difference that in place of a solution of 39.98 parts of ($\eta_{11}$) in 17.64 parts of water and 40.39 parts of dipropyleneglycol or 1,3-butenediol there is employed a solution of 39.98 parts of ($\eta_{11}$) in 58.03 parts of water. There are obtained 1633.00 parts of Product (J', K' resp. L' with good stability to shearing forces.

EXAMPLE 9

(Product M)

337.46 parts of octamethylcyclotetrasiloxane, 10.50 parts of N-aminoethyl-aminopropyl-methyldimethoxysilane and 0.75 parts of 35% solution of benzyltrimethylammonium-hydroxide in methanol are admixed together with stirring and heated to 80° C. After 4 hours at 80° C. the mixture is heated during 30 minutes to 150° C. and after 1 hour the non-reacted octamethylcyclotetrasiloxane is distilled off at 150° C. under vacuum. There are obtained 26.62 parts of distillate and 322.09 parts of an amino-modified polydimethylsiloxane, which is cooled to room temperature. At this point there are added 32.21 parts of ($\gamma_{14}$) and then an aqueous solution consisting of 644.18 parts of water 64.42 parts of ($\gamma_{21}$)

322.09 parts of a 50% aqueous solution of ($\beta_4$)

and 128.84 parts of an 80% aqueous butylmonoglucoside solution.

An opaque emulsion is obtained which is adjusted to pH 4.0 by means of 14.82 parts of glacial acetic acid and 23.83 parts of 36.5% hydrochloric acid. The opaque emulsion is now heated to 50° C. by which a clear product is formed. This is now cooled to room temperature and before discharging 82.52 parts of a 50% solution of ($\eta_{12}$) in isopropanol are added. 1633.00 parts of Product M stable to shearing forces are obtained.

Application Examples A to C

A. 1 kg of the substrate (textile material: cotton single jersey, blue) are treated at 40° C. and at a liquor-to-goods ratio of 8:1 in a Labor-jet from MATHIS (Switzerland) with 40 g of finishing agent (Products A to M). The liquor flow rate is of 60 l/min. and the treatment duration is 20 minutes. The water has a hardness of 10° dH (according to DIN 53905) and a pH of 4. After the treatment the substrate is hydroextracted, dried during 90 sec. at 140° C. without tension and tested for softness. During the treatment no deposits or soily separations occur. No spots are detected on the textile goods. After draining-off of the liquor no deposits are observed in the assembly. All products (A–M) are stable to the shearing forces and give a clear improvement of the handle of the treated textile material (in comparison to a corresponding substrate treated without silicone microemulsion).

Analogously to Application Example A there are employed Products A, B, D, E, F, G, H, J, J', K, K', L, L' or M instead of Product C.

| | | |
|---|---|---|
| B. | Machine: | Jet R95 from THIES, 3 chambers; |
| | Substrate: | 360 kg of polyester/cotton (50/50) single-jersey, dyed in green (disperse and reactive dyes) |
| | Product: | 2.0% (referred to the weight of the substrate) of Product C; |
| | Liquor volume: | 2000 l of permitite-deionized water; |
| | Goods-to-liquor-ratio: | 1:5.5; |
| | pH-value: | 4.5; |
| | Temperature: | 30° C.; |
| | Treatment duration: | 20 minutes; |
| | Cloth running speed: | 200 m/min.; |
| | Procedure: | The product pre-diluted with 150 l of the water is added during 5 min. No residues deposits or spots are formed. The aspect of the goods and the soft-handle of the dry goods are flawless. |
| C. | Machine: | 3 roll jet machine from AVESTA (Sweden); 150 kg of polyester/cotton (50/50) intimate blend tricot, dyed with reactive and disperse dyes (single bath two-step) and cationically aftertreated; |
| | Product: | 2.0% (based on the weight of the substrate) of Product C; |
| | Liquor volume: | 2200 l of permutite-deionized water; |
| | Goods-to-liquor ratio: | 1:15; |
| | pH-value: | 4.5; |
| | Temperature: | 30° C.; |
| | Treatment duration: | 20 min.; |
| | Cloth running speed: | 90 m/min.; |
| | Procedure: | The product pre-diluted in 150 l of the water is added during 5 minutes, the temperature remaining constant. When discharging the goods no spots or deposits are detectable on the goods or in the machine. After drying the treated goods display an excellent soft handle. |

Analogously as described in Application Example B and C there are employed Products H, J and K instead of Product C.

Analogously as on the AVESTA-jet the procedure of Application Example C is carried out on a GASTON-COUNTY-jet.

I claim:

1. A process for finishing a fibrous material which comprises applying, as finishing agent, to said material an aqueous microemulsion of an aminopolysiloxane ($\alpha$) which is at least in part in protonated form, said microemulsion comprising 5 to 60 parts by weight of an amphoteric surfactant (13) for every 100 parts by weight of ($\alpha$), and having a pH $\leq 7$.

2. A process according to claim 1 wherein the fibrous material is textile material and the microemulsion is applied from an aqueous liquor.

3. A process according to claim 2 wherein the aminopolysiloxane ($\alpha$) has an amine value in the range of 0.1–3.0 and a viscosity in the range of 500–30,000 cP at room temperature.

4. A process according to claim 2 wherein the amphoteric surfactant ($\beta$) is selected from the group consisting of an amino acid with at least one tertiary amino group and a betaine.

5. A process according to claim 4 wherein the amphoteric surfactant ($\beta$) contains a carboxylic or sulphonic acid group, and a lipophilic radical which is bridged by a carbamoyl group to the rest of the surfactant, or is in the 2-position substituent of an amphoteric imidazoline or of the imidazolinium ring of a betaine of the imidazolinium series.

6. A process according to claim 2 wherein the microemulsion contains at least one non-ionic emulsifier ($\gamma$).

7. A process according to claim 6 wherein at least one non-ionic emulsifier ($\gamma$) has an HLB-value in the range 5–16.

8. A process according to claim 6 wherein the microemulsion contains a non-ionic emulsifier ($\gamma_1$) having an HLB-value in the range 5–12 and non-ionic emulsifier ($\gamma_2$) having an HLB-value in the range 10–16, the HLB-value of ($\gamma_2$) being at least one unit higher than the HLB-value of ($\gamma_1$).

9. A process according to claim 8 wherein the weight ratio ($\gamma_1$):($\gamma_2$) is in the range 1:9 to 9:1.

10. A process according to claim 6 wherein the microemulsion contains, for every 100 parts by weight of aminopolysiloxane ($\alpha$), 10–60 parts by weight of non-ionic surfactant ($\gamma$).

11. A process according to claim 6 wherein the microemulsion further comprises a hydrotropic compound ($\delta$).

12. A process according to claim 2 wherein the microemulsion contains at least one cationic surfactant ($\eta$).

13. A process according to claim 12 wherein the microemulsion contains up to 30 parts by weight of ($\eta$) for every 100 parts by weight of ($\alpha$).

14. A process according to claim 2 wherein the aminopolysiloxane ($\alpha$) is of the general formula

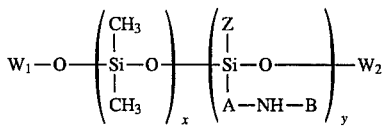

(I)

wherein $W_1$ and $W_2$ each signify a group of formula (c) or (d)

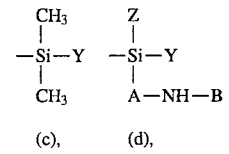

(c), (d),

A signifies a bivalent hydrocarbon radical with 2–6 carbon atoms,

B signifies hydrogen, $C_{1-4}$alkyl or —$(CH_2)$m—$NH_2$, m signifies 2 or 3,

Z signifies —$CH_3$ or —OX,

X signifies hydrogen, methyl or the link to radicals of formula (c) or (d) or a polysiloxane radical of the units in either or both sets of brackets, Y signifies methyl, methoxy or hydroxy and x and y are such that the polymers have an amine value in the range 0.1–3.0 and a viscosity at room temperature in the range 500–30,000 cP, provided that y is at least 1.

15. A process according to claim 14 wherein, in formula I, the ratio of the number of dimethylsiloxy units to the number of aminosiloxy units is in the range 3/1 to 300/1.

16. A process according to claim 15 wherein, in formula I, A is propylene-1,3 or 2-methyl-propylene-1,3, B is hydrogen, aminoethyl or aminopropyl and X is methyl.

17. A process according to claim 14 wherein, in formula I, A is propylene-1,3 or 2-methyl-propylene-1,3, B is hydrogen, aminoethyl or aminopropyl and Z is methyl.

18. A process according to claim 17 wherein the microemulsion further contains, for every 100 parts by weight of aminopolysiloxane (α), 10 to 60 parts by weight of a mixture of a non-ionic emulsifier ($\gamma_1$) having an HLB-value in the range 5–12 and a non-ionic emulsifier ($\gamma_2$) having an HLB-value in the range 10–16, the HLB-value of ($\gamma_2$) being at least one unit higher than the HLB-value of ($\gamma_1$) and the weight ratio ($\gamma_1$): ($\gamma_2$) being in the range 1:9 to 9:1.

19. A process according to claim 10 wherein the amphoteric surfactant (α) is selected from the group consisting of an amino acid with at least one tertiary amino group and a betaine.

20. A process according to claim 10 wherein the acid group in (α) is a carboxylic or sulphonic acid group and the lipophilic radical is bridged by a carbamoyl group to the rest of the molecule, or is the 2-position substituent of an amphoteric imidazoline or of the imidazolinium ring of a betaine of the imidazolinium series.

21. A process according to claim 20 in which the finishing is carried out in a jet-dyeing machine.

22. A process according to claim 17 in which the finishing is carried out in a jet-dyeing machine.

23. A process according to claim 2 in which the finishing is carried out in a jet-dyeing machine.

24. A fibrous material by the process of claim 2.

25. A fibrous textile material by the process of claim 17.

26. A process for the production of a microemulsion comprising an aminopolysiloxane (α) and an amphoteric surfactant (β), and having a pH ≦7, comprising mixing the microemulsion components with an acid (ε) wherein the acid (ε) is added before, together with and/or after the addition of (α).

27. The process according to claim 26 wherein a non-ionic emulsifier (γ), a hydrotropic compound (δ) and/or a cationic surfactant (η) are added to the microemulsion before, during, or after the addition of (β).

* * * * *

UNITED STATES PATENT AND TRADEMARK OFFICE

CERTIFICATE OF CORRECTION

PATENT NO. : 5,520,827

DATED : May 28, 1996

INVENTOR(S) : Bernard Danner, Riedisheim, France

It is certified that error appears in the above-indentified patent and that said Letters Patent is hereby corrected as shown below:

Column 18, Claim 1, line 10, "(13)" should read

-- (β) --.

Signed and Sealed this

Seventh Day of January, 1997

*Attest:*

BRUCE LEHMAN

*Attesting Officer*

*Commissioner of Patents and Trademarks*